US008844203B2

(12) United States Patent
Lahnala

(10) Patent No.: US 8,844,203 B2
(45) **Date of Patent: *Sep. 30, 2014**

(54) SLIDING WINDOW ASSEMBLY INCLUDING A DRAIN HOLE

(71) Applicant: AGC Automotive Americas, Co., Hebron, KY (US)

(72) Inventor: David W. Lahnala, Adrian, MI (US)

(73) Assignee: AGC Automotive Americas Co., Hebron, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/662,679

(22) Filed: Oct. 29, 2012

(65) Prior Publication Data

US 2013/0047513 A1 Feb. 28, 2013

Related U.S. Application Data

(63) Continuation of application No. 12/621,308, filed on Nov. 18, 2009, now Pat. No. 8,316,583.

(60) Provisional application No. 61/199,646, filed on Nov. 19, 2008.

(51) Int. Cl.

| | |
|---|---|
| ***E06B 7/14*** | (2006.01) |
| ***E05D 15/06*** | (2006.01) |
| ***E05F 11/53*** | (2006.01) |

(52) U.S. Cl.

CPC ..... *E05D 15/0686* (2013.01); *E05Y 2900/55* (2013.01); *E05F 11/535* (2013.01)

USPC ..... 49/408; 49/413; 49/410; 49/411; 49/380; 49/125

(58) Field of Classification Search

USPC ..... 49/408, 380, 413, 410, 411, 125

See application file for complete search history.

(56) References Cited

U.S. PATENT DOCUMENTS

| | | | |
|---|---|---|---|
| 3,656,260 | A | 4/1972 | Weaver et al. |
| 4,124,054 | A | 11/1978 | Spretnjak |
| 4,452,420 | A | 6/1984 | Lundquist |
| 4,543,747 | A | 10/1985 | Kaltz et al. |
| 4,635,398 | A | 1/1987 | Nakamura |

(Continued)

FOREIGN PATENT DOCUMENTS

| | | | |
|---|---|---|---|
| GB | 2159562 | A | 12/1985 |
| GB | 2229479 | A | 9/1990 |
| WO | 2007090509 | A1 | 8/2007 |

*Primary Examiner* — Katherine Mitchell
*Assistant Examiner* — Marcus Menezes
(74) *Attorney, Agent, or Firm* — Howard & Howard Attorneys PLLC

(57) ABSTRACT

A sliding window assembly for a vehicle includes a fixed panel and a sliding panel moveable relative to the fixed panel between an open position and a closed position. An elongated member is connected to the fixed panel and defines a channel extending along a longitudinal axis from a first end to a second end. The channel receives the sliding panel for movement of the sliding panel relative to the fixed panel. A rail is disposed in the channel along the longitudinal axis and is spaced along the longitudinal axis from the first end. The elongated member defines a drain hole molded into the elongated member in the channel. The drain hole is defined between the rail and the first end of the channel along the axis for draining water from the channel.

23 Claims, 10 Drawing Sheets

(56) References Cited

U.S. PATENT DOCUMENTS

| | | | | | |
|---|---|---|---|---|---|
| 4,688,752 | A | | 8/1987 | Barteck et al. | |
| 4,785,583 | A | | 11/1988 | Kawagoe et al. | |
| 4,788,796 | A | | 12/1988 | Matthews | |
| 4,795,667 | A | | 1/1989 | Armstrong | |
| 4,834,931 | A | | 5/1989 | Weaver | |
| 4,870,783 | A | | 10/1989 | Hermann et al. | |
| 4,962,601 | A | | 10/1990 | Gold | |
| 4,969,293 | A | | 11/1990 | Guillon | |
| 5,061,429 | A | | 10/1991 | Yoshihara et al. | |
| 5,228,740 | A | | 7/1993 | Saltzman | |
| 5,294,168 | A | | 3/1994 | Kronbetter | |
| 5,345,717 | A | | 9/1994 | Mori et al. | |
| 5,363,596 | A | | 11/1994 | Kronbetter | |
| 5,442,880 | A | | 8/1995 | Gipson | |
| 5,473,840 | A | * | 12/1995 | Gillen et al. | 49/380 |
| 5,505,023 | A | * | 4/1996 | Gillen et al. | 49/380 |
| 5,522,191 | A | | 6/1996 | Wenner et al. | |
| 5,531,046 | A | | 7/1996 | Kollar et al. | |
| 5,551,193 | A | | 9/1996 | Barnett | |
| 5,613,323 | A | | 3/1997 | Buening | |
| 5,669,181 | A | | 9/1997 | Kollar et al. | |
| 5,724,769 | A | | 3/1998 | Cripe et al. | |
| 5,775,029 | A | | 7/1998 | Buening | |
| 5,784,833 | A | | 7/1998 | Sponable et al. | |
| 5,799,444 | A | | 9/1998 | Friemark et al. | |
| 5,799,449 | A | | 9/1998 | Lyons et al. | |
| 5,822,922 | A | | 10/1998 | Grumm et al. | |
| 5,836,110 | A | | 11/1998 | Buening | |
| 5,964,063 | A | | 10/1999 | Hisano et al. | |
| 5,996,284 | A | | 12/1999 | Freimark et al. | |
| 5,997,793 | A | | 12/1999 | Lahnala | |
| 6,018,913 | A | | 2/2000 | Lin | |
| 6,026,611 | A | | 2/2000 | Ralston et al. | |
| 6,038,819 | A | | 3/2000 | Klein | |
| 6,112,462 | A | | 9/2000 | Kolar | |
| 6,119,401 | A | | 9/2000 | Lin et al. | |
| 6,125,585 | A | | 10/2000 | Koneval et al. | |
| 6,223,470 | B1 | | 5/2001 | Millard et al. | |
| 6,324,788 | B1 | | 12/2001 | Koneval et al. | |
| 6,495,082 | B1 | | 12/2002 | Ash et al. | |
| 6,591,552 | B1 | * | 7/2003 | Rasmussen | 49/413 |
| 6,691,464 | B2 | | 2/2004 | Nestell et al. | |
| 6,766,617 | B2 | | 7/2004 | Purcell | |
| 6,810,622 | B2 | | 11/2004 | Oberheide | |
| 6,872,353 | B2 | | 3/2005 | Gillen et al. | |
| 6,890,468 | B2 | | 5/2005 | Caldoro et al. | |
| 6,902,224 | B2 | | 6/2005 | Weinert et al. | |
| 6,955,009 | B2 | | 10/2005 | Rasmussen | |
| 6,962,350 | B2 | | 11/2005 | Berry et al. | |
| 7,003,916 | B2 | | 2/2006 | Nestell et al. | |
| 7,051,478 | B2 | * | 5/2006 | Bourque et al. | 49/413 |
| 7,073,293 | B2 | | 7/2006 | Galer | |
| 7,094,375 | B2 | | 8/2006 | Nakata | |
| 7,150,126 | B2 | | 12/2006 | Rivera | |
| RE40,636 | E | | 2/2009 | Weinert et al. | |
| 7,810,284 | B2 | | 10/2010 | Murphy et al. | |
| 8,272,168 | B2 | | 9/2012 | Lahnala | |
| 8,316,583 | B2 | * | 11/2012 | Lahnala | 49/408 |
| 8,322,075 | B2 | | 12/2012 | Lahnala | |
| 2003/0177699 | A1 | * | 9/2003 | Fukuro et al. | 49/408 |
| 2003/0188487 | A1 | * | 10/2003 | Rasmussen | 49/116 |
| 2003/0213179 | A1 | * | 11/2003 | Galer | 49/413 |
| 2004/0098919 | A1 | * | 5/2004 | Bourque et al. | 49/413 |
| 2005/0044799 | A1 | | 3/2005 | Kinross et al. | |
| 2005/0072050 | A1 | | 4/2005 | Yamamoto | |
| 2006/0032140 | A1 | | 2/2006 | Arimoto et al. | |
| 2006/0107600 | A1 | | 5/2006 | Nestell et al. | |
| 2007/0157522 | A1 | | 7/2007 | Hebert et al. | |
| 2008/0060275 | A1 | | 3/2008 | Recker | |
| 2008/0122262 | A1 | | 5/2008 | Cicala | |
| 2008/0263960 | A1 | | 10/2008 | Murphy et al. | |
| 2009/0019780 | A1 | | 1/2009 | Hansel et al. | |
| 2009/0113802 | A1 | | 5/2009 | Cicala | |
| 2009/0212591 | A1 | | 8/2009 | Seiple et al. | |
| 2010/0122496 | A1 | | 5/2010 | Lahnala | |
| 2010/0154310 | A1 | | 6/2010 | Robalo et al. | |

* cited by examiner

SLIDING WINDOW ASSEMBLY INCLUDING A DRAIN HOLE

CROSS-REFERENCE TO RELATED APPLICATIONS

The subject patent application is a continuation of U.S. patent application Ser. No. 12/621,308, filed on Nov. 18, 2009, which claims priority to and all the benefits of U.S. Provisional Patent Application Ser. No. 61/199,646 which was filed on Nov. 19, 2008, the entire specifications of which are expressly incorporated herein by reference.

BACKGROUND OF THE INVENTION

1. Field of the Invention

The invention generally relates to a sliding window assembly for a vehicle. Specifically, the invention generally relates to a sliding window assembly having a drain hole for draining water to an exterior of a vehicle.

2. Description of the Related Art

Sliding window assemblies for vehicles are known in the art and have been widely used by vehicle manufacturers. The sliding window assemblies typically include first and the second fixed panels spaced from each other to define an opening therebetween. A first track and a second track are spaced from each other and are coupled to the first and second fixed panels.

The first and second tracks each define a channel. A sliding panel is disposed within the channels and is movable across the opening between a closed position and an open position. The channels guide the sliding panel between the open and closed positions.

Under certain circumstances, such as inclement weather, water can enter the sliding window assembly from an exterior side of the sliding window assembly to an interior side of the sliding window assembly. Such a water leak may cause water damage, mold growth, etc., in the interior of the vehicle and can give the vehicle an overall feel of low quality.

Attempts to control water on the interior side of the sliding window assembly have been costly. These attempts include performing secondary steps after the assembly of the sliding window assembly to add features for controlling the water. These secondary steps require labor and time, both of which cause an unwanted increase in the cost to manufacture the sliding window assembly. Accordingly, it would be advantageous to improve the sliding window assembly.

SUMMARY OF THE INVENTION AND ADVANTAGES

The present invention includes a sliding window assembly for a vehicle comprising a first fixed panel and a second fixed panel spaced from and fixed relative to the first fixed panel defining an opening therebetween. A sliding panel is moveable relative to the first and second fixed panels for covering and uncovering the opening. A track is connected to the first fixed panel and to the second fixed panel and includes an elongated member defining a U-shaped channel and a rail disposed in the channel with the channel receiving the sliding panel for movement of the sliding panel relative to the first and second fixed panels. The channel extends along a longitudinal axis from a first end to a second end and with the rail extending along the longitudinal axis and spaced along the longitudinal axis from the first end. The elongated member defines a drain hole molded into the elongated member in the channel and defined between the rail and the first end of the channel along the longitudinal axis for draining water from the channel.

The present invention also includes a sliding window assembly for a vehicle comprising a fixed panel and a sliding panel moveable relative to the fixed panel between an open position and a closed position. An elongated member is connected to the fixed panel and defines a channel extending along a longitudinal axis from a first end to a second end and receiving the sliding panel for movement of the sliding panel relative to the fixed panel. A rail is disposed in the channel along the longitudinal axis and is spaced along the longitudinal axis from the first end. The elongated member defines a drain hole molded into the elongated member in the channel and defined between the rail and the first end of the channel along the axis for draining water from the channel.

The sliding window assembly advantageously drains water from the channel through the drain hole, for example, to prevent the disadvantages described above. Further, the location of the drain hole in the elongated member between the rail and the first end of the channel advantageously allows for the drain hole to be molded into the elongated member. By molding the drain hole into the elongated member, secondary manufacturing steps are eliminated thereby reducing labor and time to manufacture the sliding window assembly, thereby reducing the cost to manufacture the sliding window assembly.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
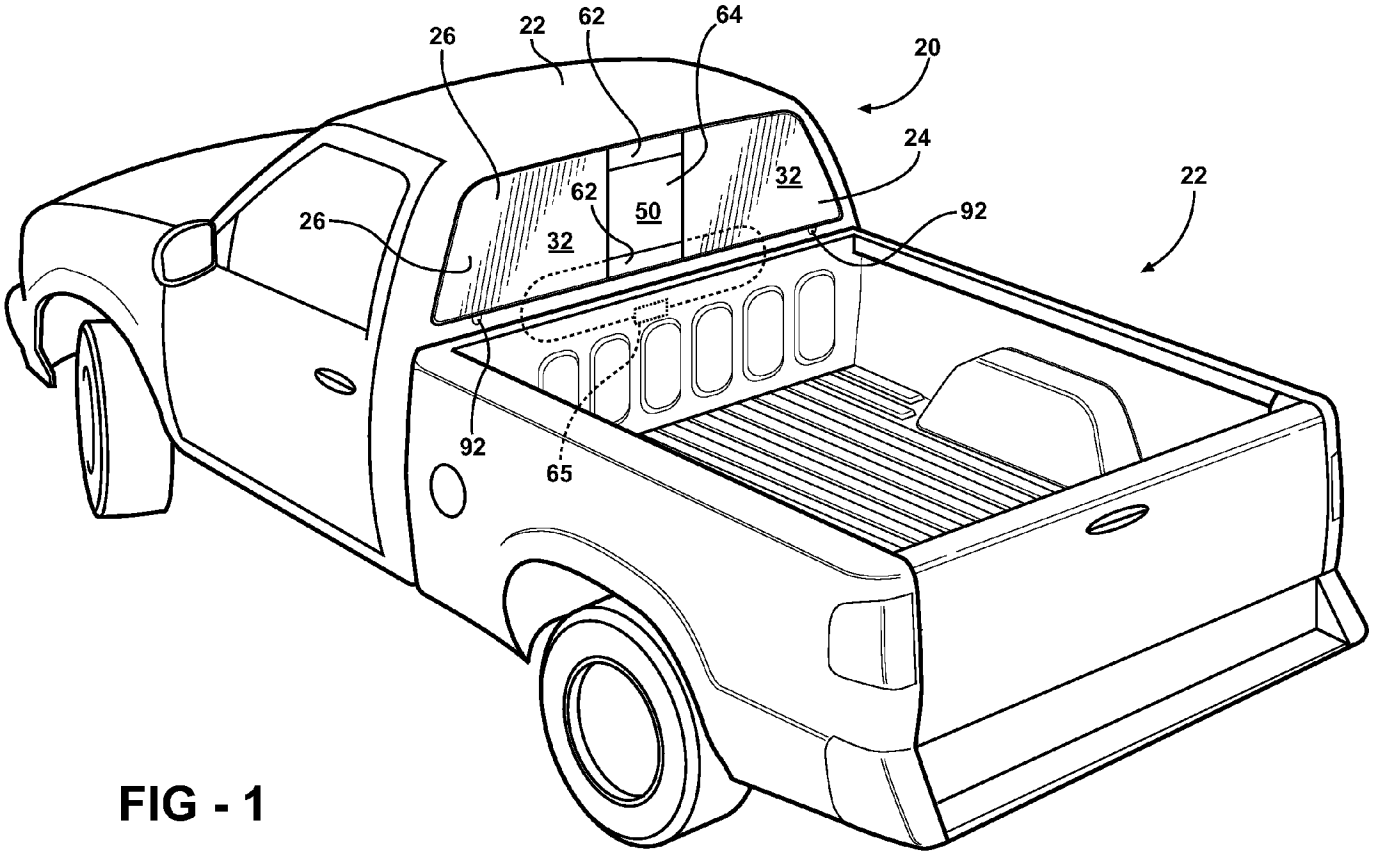
FIG. 1 is a perspective view of a vehicle including a sliding window assembly.

With reference to the Figures, wherein like numerals indicate corresponding parts throughout the several views, a sliding window assembly 20 for installation in a vehicle 22 is generally shown. Referring to FIG. 1, the sliding window assembly 20 is shown coupled to the vehicle 22, specifically as a backlite of a pickup truck. However, it is to be appreciated that the sliding window assembly 20 of the present invention can be implemented in other types of vehicles, as well as in non-vehicle applications.

As shown in FIGS. 1-4, the sliding window assembly 20 includes at least one fixed panel 24, 26 configured for coupling with the vehicle 22. The at least one fixed panel typically includes a first fixed panel 24 and a second fixed panel 26 spaced from and fixed relative to the first fixed panel 24 defining an opening 28 therebetween. The first and second fixed panels 24, 26 have an interior surface 30, shown in FIG. 3, for facing an interior of the vehicle 22 and an exterior surface 32, shown in FIG. 2, for facing an exterior of the vehicle 22 when the sliding window assembly 20 is coupled to the vehicle 22. It should be appreciated that the sliding window assembly 20 can include one, two, or more fixed panels without departing from the nature of the present invention.

A sliding panel 64 is moveable relative to the first and second fixed panels 24, 26 for covering the opening 28 in a closed position and for uncovering the opening 28 in an open position. The sliding panel 64 is covering the opening 28 in a closed position in FIGS. 1 and 3 and is partially covering the opening 28 between the open and closed positions in FIG. 2. Typically, the sliding panel 64 completely uncovers the opening 28 in the open position, which is not shown in the Figures. The first and second fixed panels 24, 26 and the sliding panel 64 are typically formed of glass. However, the first and second fixed panels 24, 26 and the sliding panel 64 may be formed from any suitable material such as plastic, metal, etc.

The sliding panel 64 presents an exterior surface 50 and an opposing interior surface 52. The exterior surface 50 of the sliding panel 64 faces the exterior of the vehicle 22 and the interior surface 52 of the sliding panel 64 faces the interior of the vehicle 22 when the sliding window assembly 20 is coupled to the vehicle 22. The sliding panel 64 can be configured to be manually moved relative to the first and second fixed panels 24, 26 or can be configured to be moved under the power of a motor 65 operatively coupled to the sliding panel 64 for moving the sliding panel 64 relative to the first and second fixed panels 24, 26.

Figure 3:
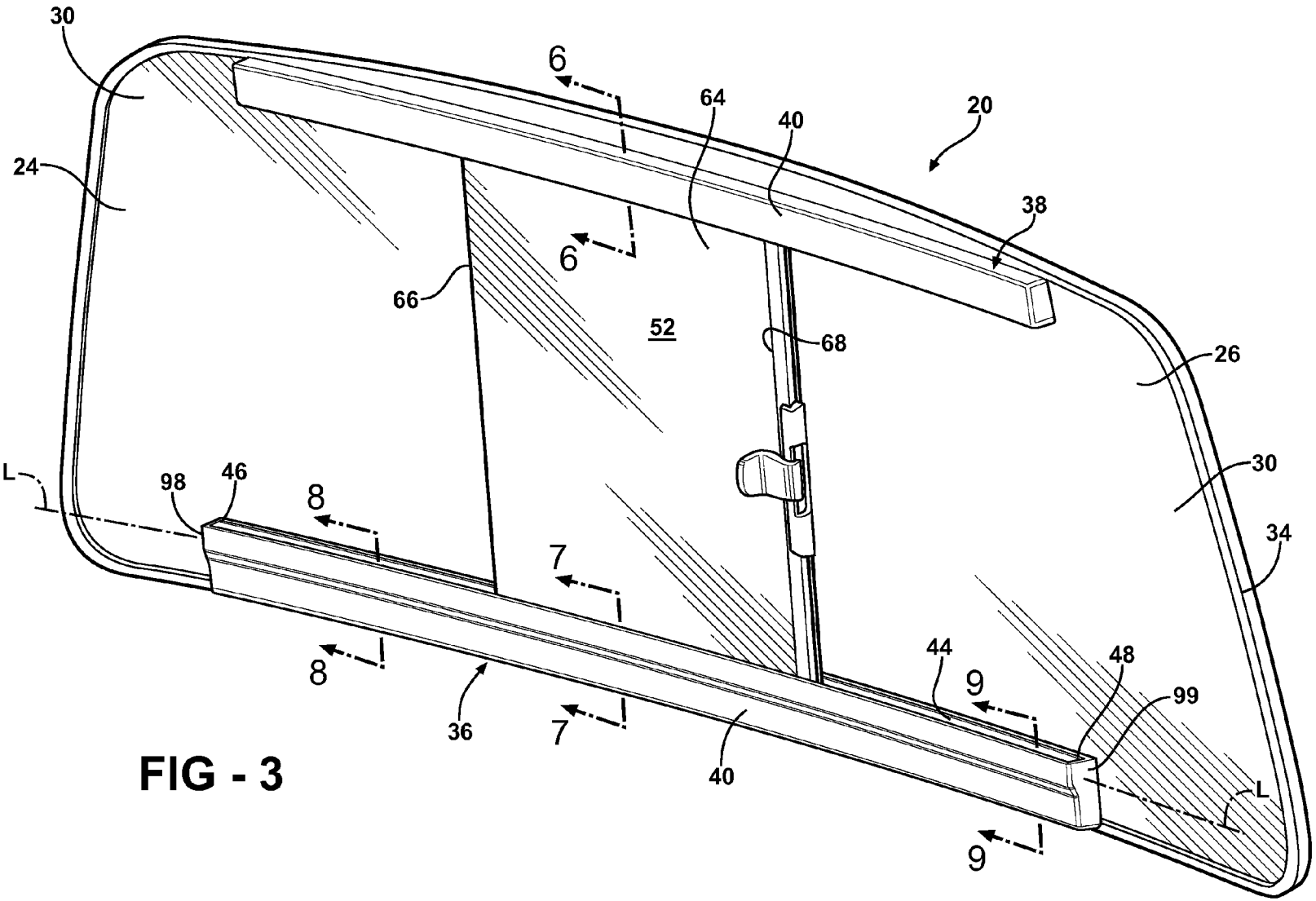
FIG. 3 is a perspective view of the sliding window assembly from an interior side of the vehicle.
Figure 4:
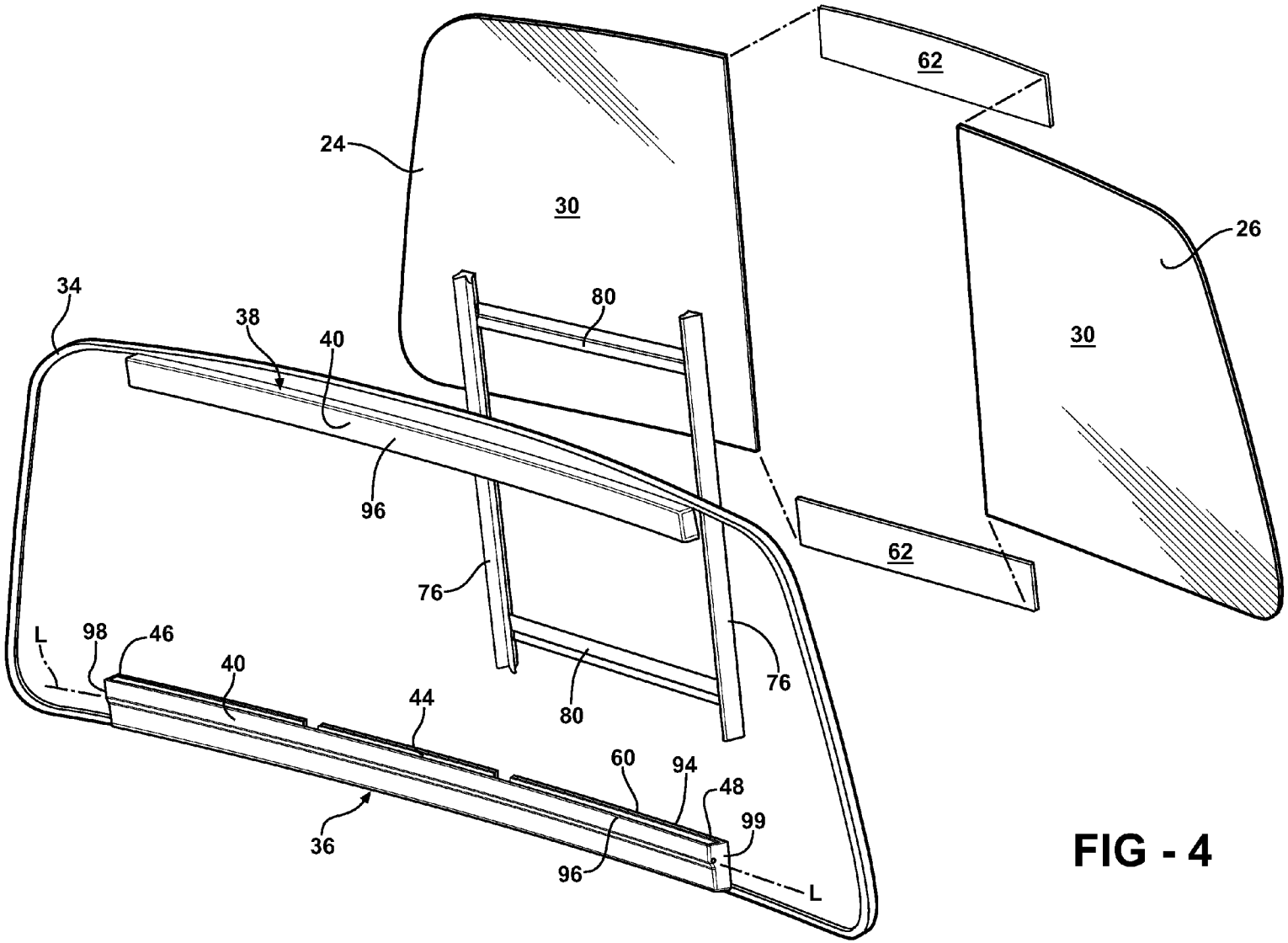
FIG. 4 is a partially exploded view of a portion of the sliding window assembly.
Figure 5:
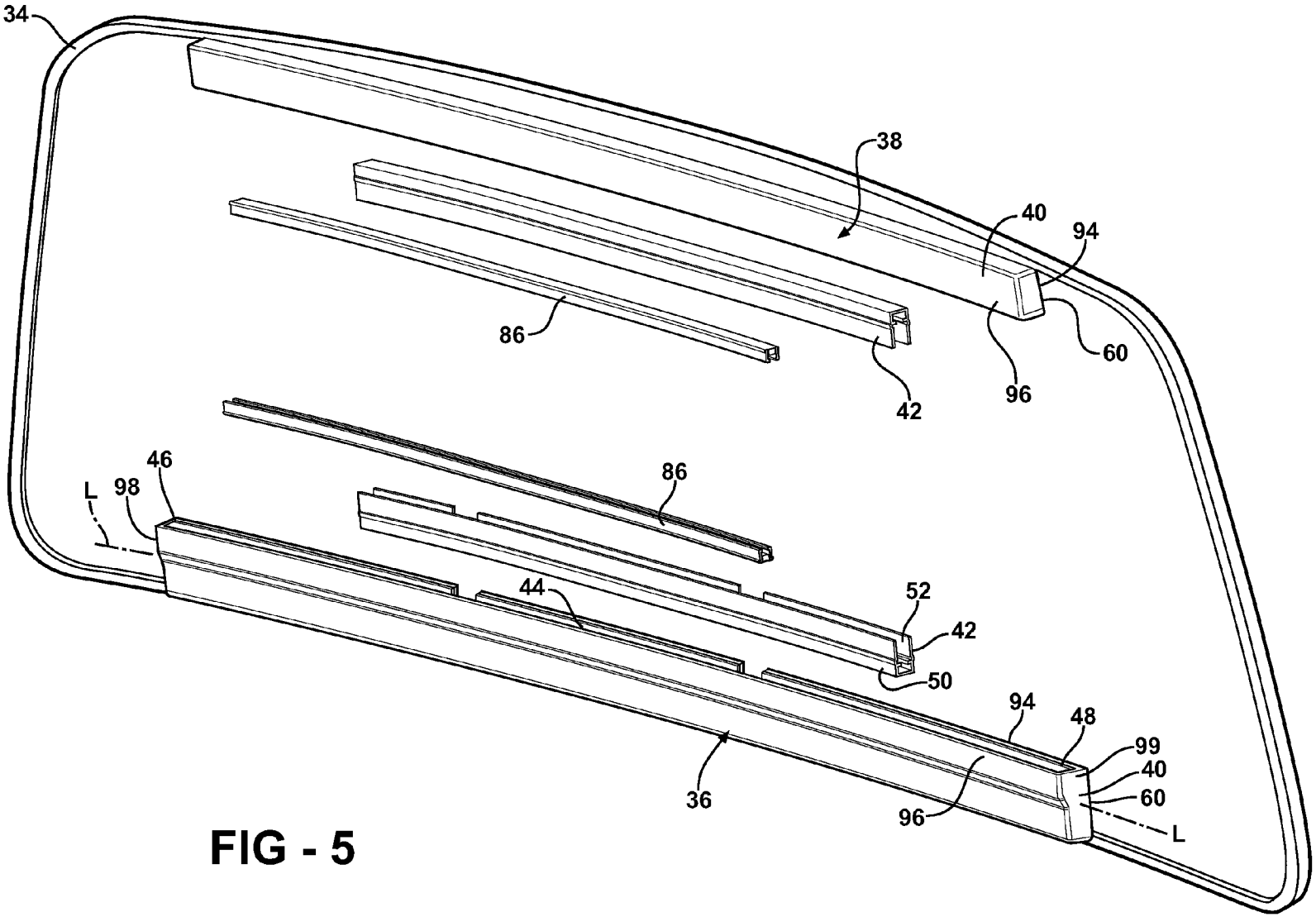
FIG. 5 is another partially exploded view of a portion of the sliding window assembly.
Figure 6:
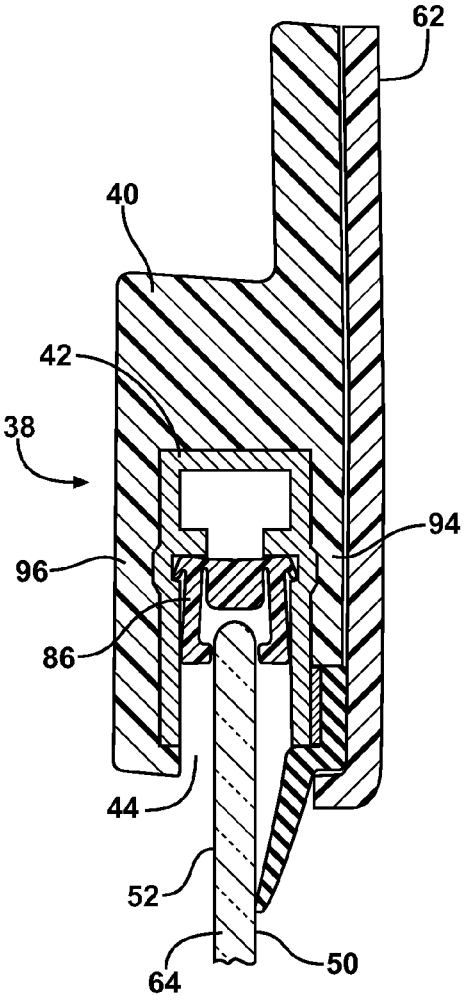
FIG. 6 is a cross-sectional view of a portion of the sliding window assembly along line 6 of FIG. 3.
Figure 7:
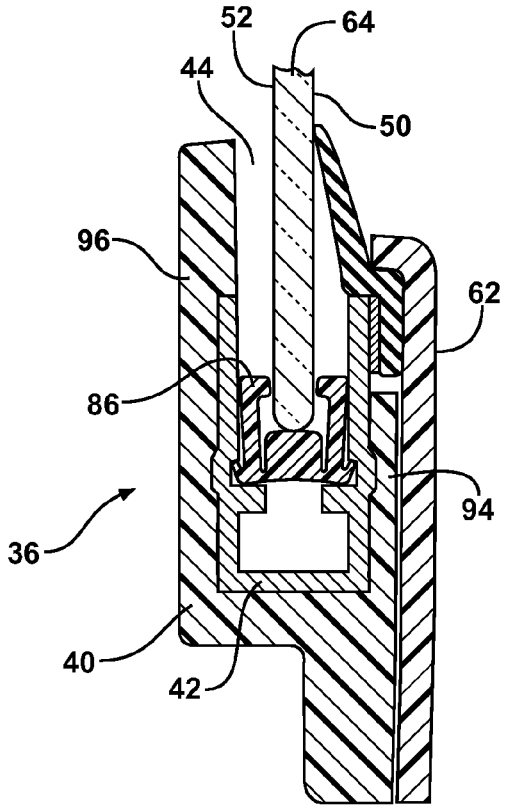
FIG. 7 is a cross-sectional view of a portion of the sliding window assembly along line 7 of FIG. 3.

As best shown in FIGS. 3-5, the sliding window assembly 20 includes at least one track 36, 38, commonly referred to as a run channel industry. The track 36, 38 is connected to at least one, and typically both, of the first and second fixed panels 24, 26. The at least one track includes a first track 36 coupled to the first and second fixed panels 24, 26 and a second track 38 coupled to the first and second fixed panels 24, 26 spaced from and substantially parallel to the first track 36. At least one, and typically both, of the first and second tracks 36, 38 rigidly interconnect the first and second fixed panels 24, 26. The first and second tracks 36, 38 span the opening 28 defined between the first and second fixed panels 24, 26. It should be appreciated that the sliding window assembly can include one, two, or more tracks without departing from the nature of the present invention.

With reference to FIG. 5, each of the first and second tracks 36, 38 typically includes an elongated member 40 and a rail 42 coupled to the elongated member 40. The elongated member 40 is connected to and extends between the first and second fixed panels 24, 26. As shown in FIGS. 5-11, each of the elongated members 40 defines a channel 44 with the rail 42 disposed in the channel 44. It is to be appreciated that the tracks 36, 38 may alternatively be manufactured without the rail 42.

The rail 42 is rigid relative to the elongated member 40 for reinforcing the elongated member 40. In other words, the rail 42 provides structural reinforcement to the elongated member 40. The rail 42 is typically U-shaped and has an exterior surface 54 and an interior surface 56. The interior surface 56 receives the sliding panel 64. The rail 42 is typically formed of metal such as aluminum; however, it is to be appreciated that the rail 42 may be formed of any suitable material without departing from the scope of the present invention.

The sliding panel 64 is in sliding engagement with the first and second tracks 36, 38 and is slideable along the first and second tracks 36, 38 relative to the first and second fixed panels 24, 26. The first and second tracks 36, 38 guide the sliding panel 64 as the sliding panel 64 moves between the closed position for covering the opening 28 and the open position for uncovering the opening 28.

Figure 2:
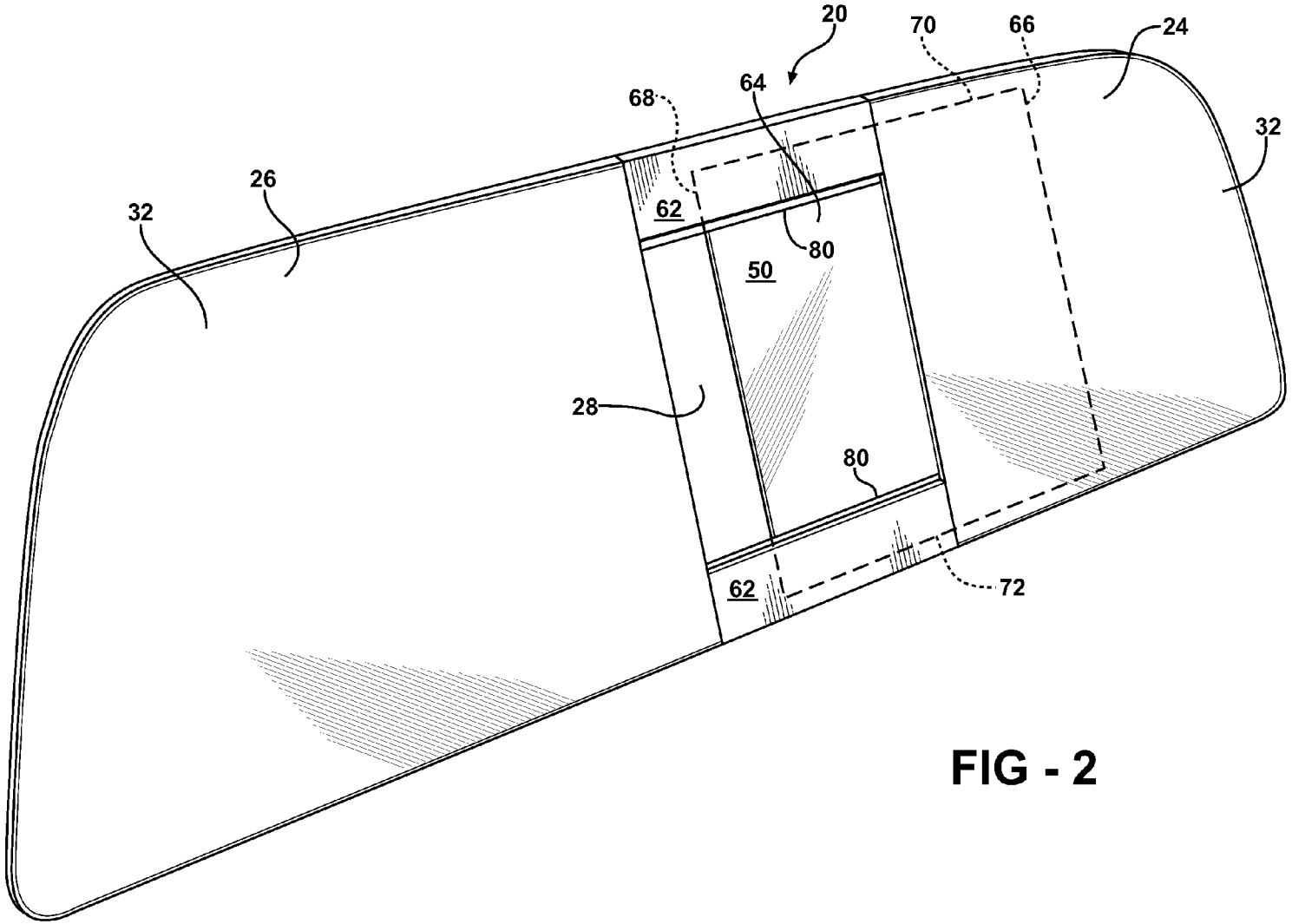
FIG. 2 is a perspective view of the sliding window assembly from an exterior side of the vehicle.

As shown in FIG. 2, the sliding panel 64 has a top edge 70 and a bottom edge 72 spaced from the top edge 70. The channel 44 of each of the first and second tracks 36, 38 receives the sliding panel 64 for movement of the sliding panel 64 relative to the first and second fixed panels 24, 26. The bottom edge 72 of the sliding panel 64 is disposed within the first track 36, i.e., by the interior surface 56 of the rail 42, and the top edge 70 of the sliding panel 64 is disposed within the second track 38, i.e., by the interior surface 56 of the rail 42.

As shown in FIG. 3, the sliding panel 64 has a first edge 66 and a second edge 68 spaced from the first edge 66. The sliding panel 64 is disposed in an offset relationship to the first and second fixed panels 24, 26. Said differently, the first edge 66 of the sliding panel 64 overlaps the first fixed panel 24 and the second edge 68 of the sliding panel 64 overlaps the second fixed panel 26 when the sliding panel 64 is in the closed position. Alternatively, the first and second tracks 36, 38 can be configured such that the sliding panel 64 is flush with the first and second fixed panels 24, 26 when the sliding panel 64 is in the closed position.

The sliding panel 64 typically slides horizontally along the first and second tracks 36, 38, but it should be appreciated that the sliding panel 64 can also slide in other directions, e.g., vertically, without departing from the nature of the present invention. In FIGS. 1 and 2, the sliding panel 64 slides to the right to the open position and slides to the left to the closed position, but it should be appreciated that the sliding panel 64 can slide in any direction between the open and closed position without departing from the nature of the present invention. It should also be appreciated that the sliding panel 64 can slide in more than one direction from the closed to the open positions. Typically, when the sliding panel 64 is moveable horizontally, the first and second tracks 36, 38 extend generally horizontally along the periphery of the first and second fixed panels 24, 26. Alternatively, when the sliding panel 64 is moveable vertically, the first and second tracks 36, 38 extend generally vertically between the periphery of the first and second fixed panels 24, 26.

The channel 44 extends along a longitudinal axis L from a first end 46 to a second end 48. The rail 42 extends along the longitudinal axis L and is spaced along the longitudinal axis L from the first end 46 and from the second end 48. In other words, the rail 42 does not extend to the first end 46 or the second end 48. The channel 44 is typically U-shaped for receiving the sliding panel 64.

As best shown in FIGS. 8-12, the elongated member 40 defines at least one drain hole 88 molded into the elongated member 40 in the channel 44. The drain hole 88 is defined between the rail 42 and the first end 46 of the channel 44 along the longitudinal axis L for draining water from the channel 44. Specifically, the elongated member 40 includes a bottom surface 90 of the channel 44 extending from the rail 42 to the first end 46. The drain hole 88 is defined through the bottom surface 90 such that water drains downwardly through the drain hole 88 by gravity. Typically the drain hole 88 drains the water onto a surface (not shown) of the vehicle 22. For example, the vehicle 22 can define weep holes 92 through which the water can drain from the surface to an exterior of the vehicle 22. It should be appreciated that the drain hole 88 can be of any size and shape without departing from the nature of the present invention. It should also be appreciated that the elongated member 40 can define any number of drain holes without departing from the nature of the present invention.

With reference to FIG. 3, the elongated member 40 typically includes a first side wall 94 and a second side wall 96 extending transverse to the bottom surface 90. Specifically, the first and second side walls 94, 96 extend upwardly from the bottom surface 90. The first side wall 94 is connected to the first fixed panel 24 and the second side wall 96 is spaced from the first side wall 94.

An end wall 98 extends transverse to the bottom surface 90 at the first end 46 of the channel 44 for retaining water within the channel 44. The first and second side walls 94, 96 extend from the rail 42 to the end wall 98. The portion of the channel 44 at the drain hole 88 is pocketed by the first and second side walls 94, 96 and the end wall 98 to direct the water toward the drain hole 88.

Figure 10:
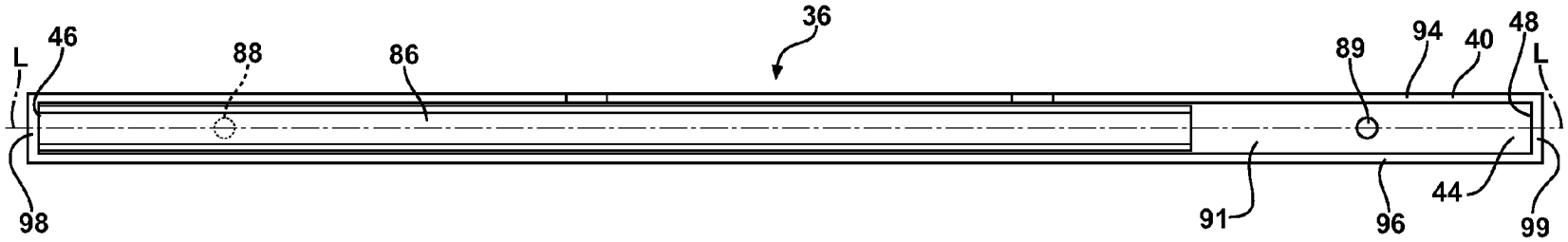
FIG. 10 is a top view of a first elongated member of the sliding window assembly of FIG. 3.
Figure 11:
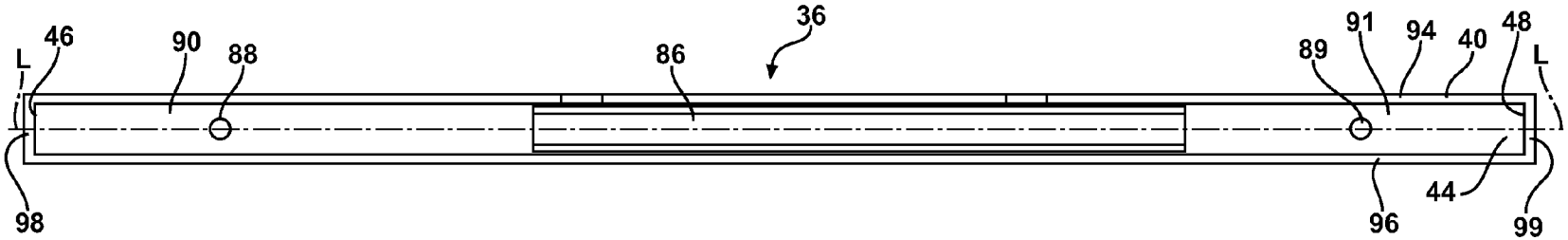
FIG. 11 is a top view of an alternative embodiment of the first elongated member of the sliding window assembly.
Figure 12:
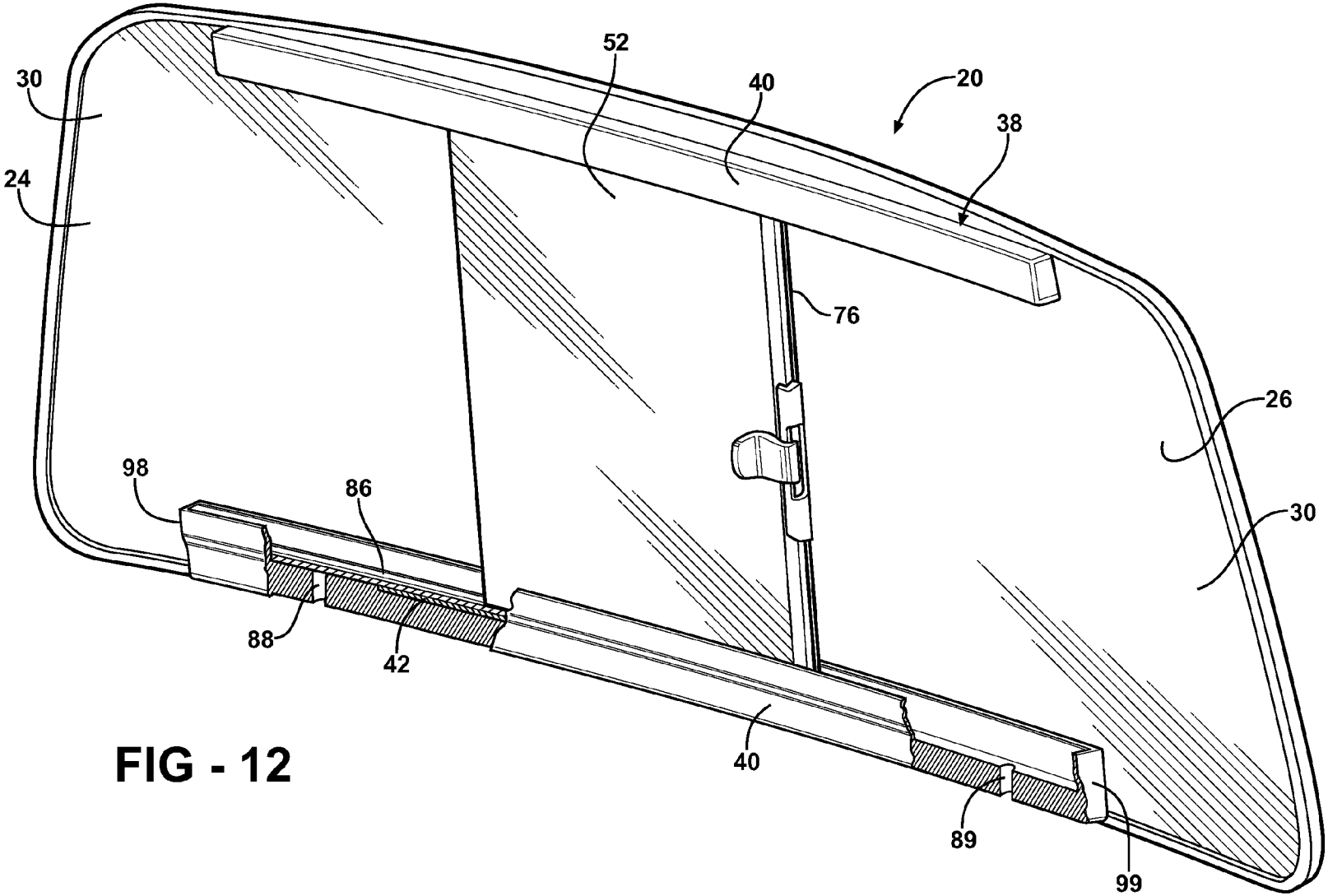
FIG. 12 is a partial cut-away perspective view of the sliding window assembly from an interior side of the vehicle.

As shown in FIGS. 10 and 11, the elongated member 40 may include a second bottom surface 91 of the channel 44 extending from the rail 42 to the second end 48 of the channel 44. The second bottom surface 91 defines a second hole 89 between the rail 42 and the second end 48. A second end wall 99 extends transverse to the second bottom surface 91 at the second end 48.

In such a configuration, typically the first and second side walls 94, 96 extend from the first end 46 to the second end 48 of the channel 44. The first and second side walls 94, 96 extend transverse to the second bottom surface 91. Specifically, the first and second side walls 94, 96 extend upwardly from the second bottom surface 91. The first and second side walls 94, 96 extend from the rail 42 to the second end wall 99 so that the portion of the channel 44 at the second drain hole 89 is pocketed by the first and second side walls 94, 95 and the end wall 98 to direct the water toward the second drain hole 89.

An insert 86 can be disposed in the channel 44 between the rail 42 and the sliding panel 64 for reducing friction as the sliding panel 64 moves relative to the first and second fixed panels 24, 26. At least the bottom edge 72 of the sliding panel 64 is in sliding engagement with the insert 86 such that the sliding panel 64 is slideable along the insert 86. The insert 86 reduces the coefficient of friction between the sliding panel 64 and the tracks 36, 38 for reducing the work required to move the sliding panel 64 between the open and closed positions. The insert 86 is typically fixed within the first and second tracks 36, 38 to prevent the insert 86 from moving along the first and second tracks 36, 38.

Figure 8:
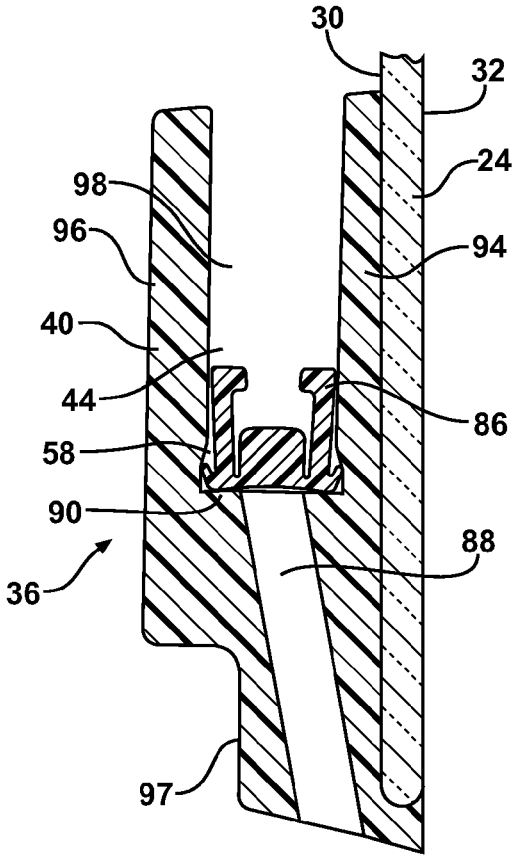
FIG. 8 is a cross-sectional view of a portion of the sliding window assembly along line 8 of FIG. 3.
Figure 9:
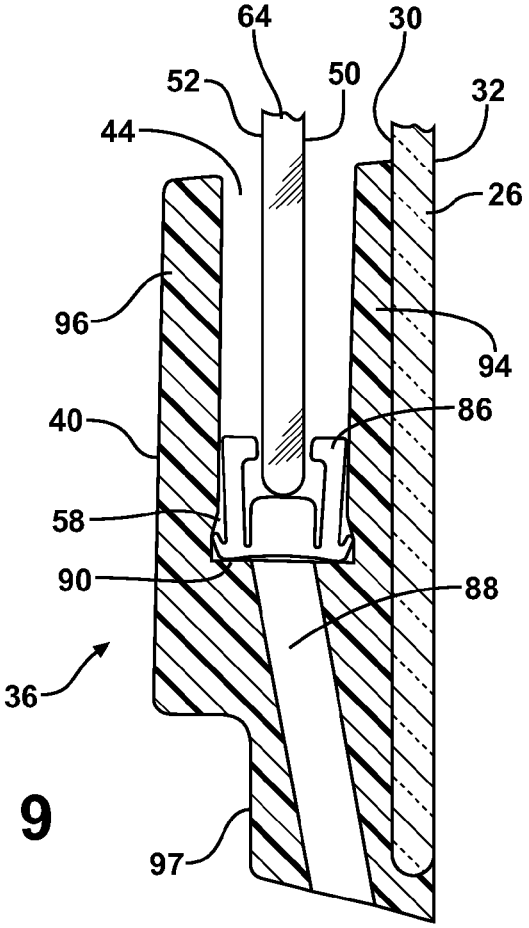
FIG. 9 is a cross-sectional view of a portion of the sliding window assembly along line 9 of FIG. 3.

With reference to FIG. 10, the insert 86 can be disposed in the channel 44 along the rail 42 and the bottom surface 90 of the channel 44. The insert 86 is disposed over the drain hole 88 and the insert 86 and the first track 36 define a flow path 58 therebetween and in communication with the drain hole 88 for flowing water through the drain hole 88. In other words, the flow path 58 allows the water to freely drain therethrough from above and/or on the sides of the insert 86 to the drain hole 88. In FIGS. 8 and 9, water is able to weep between the insert 86 and the elongated member 40 in the areas where the insert 86 touches the elongated member so that water can freely drain from above and/or on the sides of the insert 86 to the drain hole 88.

With reference to FIG. 10, the sliding panel 64 slides along the insert 86 from the closed position to the open position. Alternatively, as shown in FIG. 11, the insert 86 may extend along the rail 42 from the bottom surface 90 to the second bottom surface 91 of the channel 44, i.e., terminating at and not extending over the bottom surface 90. In such a configuration, the bottom surface 90 of the channel 44 is typically configured to match the shape of the insert 86 such that the sliding panel 64 smoothly slides from the insert 86 to the bottom surface 90 as the sliding panel 64 slides from the closed position to the open position. Alternatively, in a configuration not including the insert 86, the rail 42 and the bottom surface 90 of the channel 44 are aligned such that the sliding panel 64 smoothly slides from the rail 42 to the bottom surface 90 as the sliding panel 64 slides from the closed position to the open position.

The first and second tracks 36, 38 are typically connected to the first and second fixed panels 24, 26 by adhesive surface bonding. Although not required, adhesive surface bonding can be a process referred to in industry as glass encapsulation. The glass encapsulation process can be further defined as single-sided encapsulation, two-sided encapsulation, or three-sided encapsulation. For example, with single-sided encapsulation, the first and second tracks 36, 38 are coupled to the interior surface 30 of the first and second fixed panels 24, 26 leaving the exterior surface 32 of the first and second fixed panels 24, 26 free of adhesive surface bonding. In the embodiment shown in the Figures, the first and second tracks 36, 38 are coupled to the first and second fixed panels 24, 26 by two-sided encapsulation, i.e., the first and second tracks 36, 38 wrap around two sides of the first and second fixed panels 24, 26. It should be appreciated that the adhesive surface bonding can be any type of adhesive surface bonding other than glass encapsulation without departing from the nature of the present invention.

In glass encapsulation, an encapsulant material forms at least a portion of the first and second tracks 36, 38 and connects the first and second tracks 36, 38 to the first and second fixed panels 24, 26. Specifically, the elongated member 40 is formed of the encapsulant material and is coupled to the first and second fixed panels 24, 26 by glass encapsulation. The encapsulant material is typically introduced to the first and second fixed panels 24, 26 in molten form and solidifies as the first and second tracks 36, 38. As such, the first and second tracks 36, 38 are formed of encapsulated material, i.e., encapsulant material that was formed into the shape of the first and second tracks 36, 38 in the molten state and solidified as the first and second tracks 36, 38 during the glass encapsulation process. The encapsulant material is typically polyvinyl chloride (PVC). However, it should be appreciated that the encapsulant material may be formed from any type of material suitable for glass encapsulation.

The elongated member 40 is connected to the rail 42 and to the first and second fixed panels 24, 26 by glass encapsulation. In other words, the encapsulant material at least partially encompasses the exterior surface 54 of the rail 42 to couple the rail 42 and the first and second fixed panels 24, 26. In such an embodiment, the first and second tracks 36, 38 are each integral with the first and second fixed panels 24, 26. Specifically, the elongated member 40 of the first track 36 is integral with the rail 42 of the first track 36 and with the first and second fixed panels 24, 26. Likewise, the elongated member 40 of the second track 38 is integral with the rail 42 of the second track 38 and with the first and second fixed panels 24, 26. In other words, the first and second tracks 36, 38 and the first and second fixed panels 24, 26 form a single continuous unit. It should be appreciated that even though the elongated member 40 and the rail 42 are integral, the elongated member 40 and the rail 42 are shown in an exploded view in FIG. 5 in order to show details of these parts.

Figure 13:
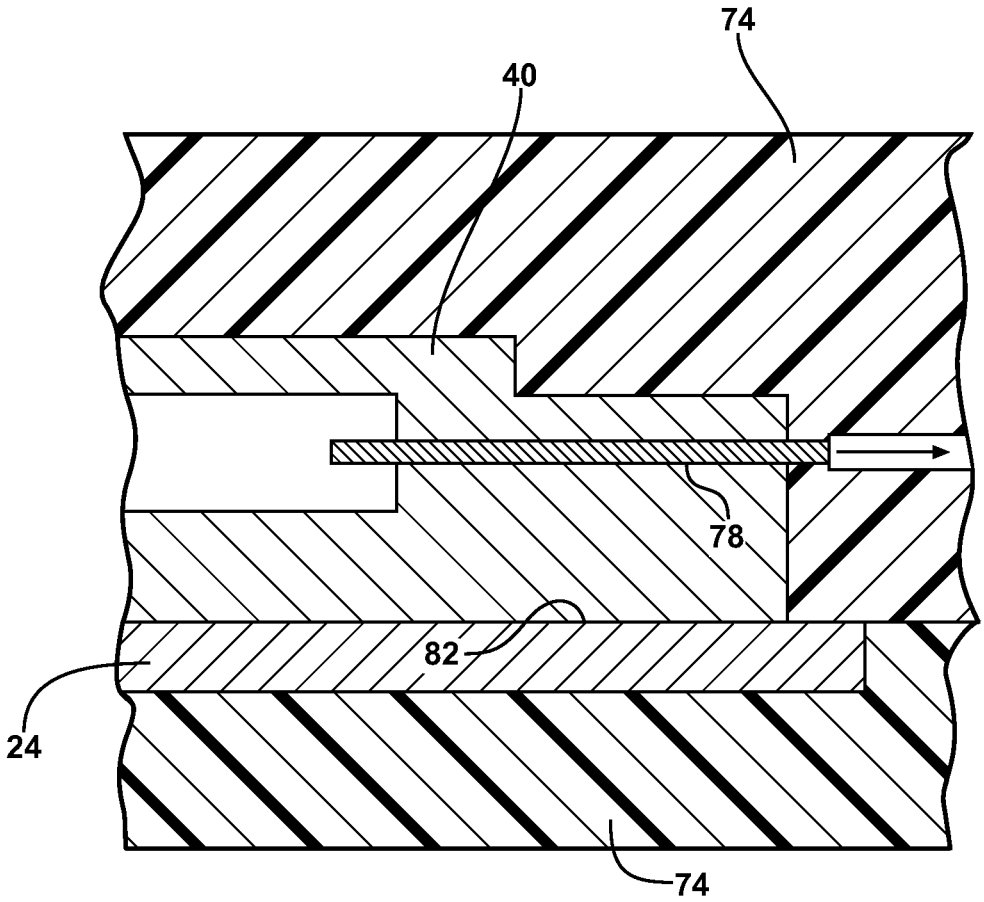
FIG. 13 is a cross-sectional view of a mold used to form the sliding window assembly.

The drain hole 88 is molded into the elongated member 40. In other words, the drain hole 88 is formed by molding during the formation of the elongated member 40. FIG. 13 shows a cross-sectional view of a portion of a mold 74 used for forming the elongated members 40 by glass encapsulation. It should be appreciated that the mold 74 is exemplary and the elongated member 40 can be formed in molds of varying design and shape without departing from the nature of the present invention.

When the mold 74 is closed, as shown in FIG. 13, the first and second fixed panels 24, 26 are disposed in the mold 74. The mold 74 defines a cavity 82 for injection of the encapsulant material for formation of the elongated members 40. When injected into the cavity 82, the encapsulant material cures to form the elongated member 40 affixed to the first and second fixed panels 24, 26.

The mold 74 includes a pin 78 for forming the drain hole 88. The pin 78 is in the extended position as shown in FIG. 13 when encapsulant material is injected into the cavity 82. After the encapsulant material is injected into the cavity 82 and cures, the pin 78 is moved to a retracted position in the direction of the arrow in FIG. 13 after which the elongated member 40 can be removed from the mold 74. As such, the elongated member 40 is removed from the mold 74 with the drain hole 88 defined therein to eliminate secondary manufacturing steps to form the drain hole 88. While the cross-section of FIG. 13 shows the formation of the drain hole 88, it should be appreciated that the second drain hole 89 and any other drain holes are molded into the elongated member in the same fashion as the drain hole 88.

With reference to FIGS. 8 and 9, the elongated member 40 includes a mount surface 97, which is mounted to the vehicle 22. The vehicle 22 presents an upstanding flange (not shown) to which the mount surface 97 is attached. Typically, adhesive such as urethane adhesive is applied to the mount surface 97 for adhering the elongated member 40 to the flange. The adhesive between the flange and the elongated member 40 prevents water from traveling from the drain holes 88, 89 to an interior of the vehicle.

As shown in FIG. 4, each elongated member 40 presents a mounting surface 60 with an applique 62 mounted to the mounting surface 60 of each elongated member 40. Specifically, the applique 62 is situated in the opening 28 between the first and second fixed panels 24, 26 along the first and second tracks 36, 38. The first and second fixed panels 24, 26 and the applique 62 are substantially flush relative each other. The applique 62 is typically formed of a polycarbonate plastic, but can be formed of other plastics, glass, metal, and the like. In the configuration where the elongate members are formed by glass encapsulation, the applique 62 is typically attached to the elongated member 40 by glass encapsulation. However, it should be appreciated that the applique 62 may be attached to the elongated member 40 in any fashion, for example by adhesive.

As shown in FIG. 4, the sliding window assembly 20 includes a pair of vertical seals 76 and a pair of horizontal seals 80 for collectively sealing the sliding panel 64 relative to the first and second fixed panels 24, 26 and the first and second tracks 36, 38. Each of the vertical seals 76 is coupled to a respective one of the first and second fixed panels 24, 26 between the first and second tracks 36, 38. The vertical seals 76 contact the sliding panel 64 when the sliding panel 64 is in the closed position. When the sliding panel 64 is in the open position, only one of the vertical seals 76 contacts the sliding panel 64.

Each of the horizontal seals 80 is coupled to a respective one of the first and second tracks 36, 38 and contacts the sliding panel 64. It is to be appreciated that the horizontal seals 80 contact the sliding panel 64 when the sliding panel 64 is in the open position, closed position or any position in between. Typically, the vertical seals 76 and at least one of the horizontal seals 80 are integral with each other such that the vertical seals 76 and one of the horizontal seals 80 is a one-piece seal. It is to be appreciated that the vertical seals 76 and the horizontal seals 80 may be formed separately or may be integral with one another without departing from the scope of the present invention.

The vertical and horizontal seals 76, 80 are typically coupled, e.g., adhered to the first and second fixed panels 24, 26 and the first and second tracks 36, 38 with tape. However, it should be appreciated that the vertical and horizontal seals 76, 80 may be coupled to the first and second fixed panels 24, 26 and the tracks in any fashion, for example, with adhesive. The vertical and horizontal seals 76, 80 are formed of any suitable material without departing from the nature of the present invention. For example, the vertical and horizontal seals 76, 80 are ethylene propylene diene monomer. Alternatively, for example, the vertical and horizontal seals 76, 80 are thermoplastic vulcanizates or thermoplastic elastomer. Typically, the vertical and horizontal seals 76, 80 are applied after the adhesive surface bonding, e.g., the glass encapsulation of the first and second tracks 36, 38 to the first and second fixed panels 24, 26, but can be applied at any time.

Although not required, the sliding window assembly can include a frame member 34 surrounding a periphery of the first and second fixed panels 24, 26. The frame member 34 may be integral with the first and second tracks 36, 38. The frame member 34 can be formed by encapsulation and can comprise any suitable material.

The invention has been described in an illustrative manner, and it is to be understood that the terminology which has been used is intended to be in the nature of words of description rather than of limitation. Obviously, many modifications and variations of the present invention are possible in light of the above teachings, and the invention may be practiced otherwise than as specifically described.

What is claimed is:

1. A sliding window assembly for a vehicle, said sliding window assembly comprising:

a first fixed panel;

a second fixed panel spaced from and fixed relative to said first fixed panel defining an opening therebetween;

a sliding panel moveable relative to said first and second fixed panels for covering and uncovering said opening; and a track connected to said first fixed panel and to said second fixed panel and including an elongated member defining a U-shaped channel and a rail disposed in said channel with said channel receiving said sliding panel for movement of said sliding panel relative to said first and second fixed panels;

said channel extending along a longitudinal axis and having a first end to a second end and with said rail extending along said longitudinal axis and spaced along said longitudinal axis from said first end;

said elongated member defining a drain hole molded into said elongated member in said channel and defined between an end of said rail and said first end of said channel for draining water from said channel.

2. The sliding window assembly as set forth in claim 1 wherein said elongated member includes a first bottom surface of said channel extending from said rail to said first end with said drain hole defined through said first bottom surface.

3. The sliding window assembly as set forth in claim 2 wherein said elongated member includes a first side wall connected to said first and second fixed panels and a second side wall spaced from said first side wall with each of the first and second side walls extending transverse to said first bottom surface with said drain hole disposed between said first and second side walls.

4. The sliding window assembly as set forth in claim 3 further comprising a first end wall extending transverse to said first bottom surface at said first end of said channel and extending from said first side wall to said second side wall for retaining water within said channel.

5. The sliding window assembly as set forth in claim 4 further comprising a second bottom surface of said channel extending from said rail to said second end and defining a second drain hole between said rail and said second end.

6. The sliding window assembly as set forth in claim 5 further comprising a second end wall extending transverse to said second bottom surface at said second end and wherein said first and second side walls extend transverse to said second bottom surface from said rail to said second end wall.

7. The sliding window assembly as set forth in claim 2 further including an insert disposed in said channel along said rail and said bottom surface of said channel.

8. The sliding window assembly as set forth in claim 1 further including an insert disposed in said channel and disposed over said drain hole wherein said insert and said track define a flow path therebetween and in communication with said drain hole for flowing water through said drain hole.

9. The sliding window assembly as set forth in claim 1 further including an insert disposed in said channel between said rail and said sliding panel for reducing friction as the sliding panel moves relative to the first and second fixed panels.

10. The sliding window assembly as set forth in claim 1 wherein said rail is rigid relative to said elongated member for reinforcing said elongated member.

11. The sliding window assembly as set forth in claim 1 wherein said elongated member is connected to said rail and to said first and second fixed panels by adhesive surface bonding.

12. The sliding window assembly as set forth in claim 1 wherein said elongated member is formed of encapsulated material and wherein said elongated member is connected to said rail and to said first and second fixed panels by encapsulation.

13. The sliding window assembly as set forth in claim 12 wherein said encapsulated material is further defined as polyvinyl chloride.

14. The sliding window assembly as set forth in claim 13 wherein said rail is formed of metal and is rigid relative to said elongated member for reinforcing said elongated member.

15. The sliding window assembly as set forth in claim 1 further including a motor operatively coupled to said sliding panel for moving said sliding panel relative to said first and second fixed panes.

16. A sliding window assembly for a vehicle, said sliding window assembly comprising:

a fixed panel;

a sliding panel moveable relative to said fixed panel between an open position and a closed position;

an elongated member connected to said fixed panel and defining a channel extending along a longitudinal axis and having a first end to a second end and receiving said sliding panel for movement of said sliding panel relative to said fixed panel; and a rail disposed in said channel along said longitudinal axis and spaced along said longitudinal axis from said first end;

said elongated member defining a drain hole molded into said elongated member in said channel and defined between an end of said rail and said first end of said channel for draining water from said channel.

17. The sliding window assembly as set forth in claim 16 wherein said elongated member includes a bottom surface of said channel extending from said rail to said first end of said channel with said drain hole defined through said bottom surface.

18. The sliding window assembly as set forth in claim 17 wherein said elongated member includes a first side wall connected to said first fixed panel and a second side wall spaced from said first side wall with each of the first and second side walls extending transverse to said bottom surface with said drain hole disposed between said first and second side walls.

19. The sliding window assembly as set forth in claim 18 further comprising an end wall extending transverse to said bottom surface at said first end of said channel and extending from said first side wall to said second side wall for retaining water within said channel.

20. The sliding window assembly as set forth in claim 17 further including an insert disposed in said channel along said rail and said bottom surface of said elongated member.

21. The sliding window assembly as set forth in claim 16 further including an insert disposed in said channel and disposed over said drain hole wherein said insert and said elongated member define a flow path therebetween and in communication with said drain hole for flowing water through said drain hole.

22. The sliding window assembly as set forth in claim 16 wherein said elongated member is formed of encapsulated material and wherein said elongated member is connected to said rail and to said first and second fixed panels by encapsulation.

23. The sliding window assembly as set forth in claim 22 wherein said encapsulated material is further defined as polyvinyl chloride.

* * * * *

UNITED STATES PATENT AND TRADEMARK OFFICE

CERTIFICATE OF CORRECTION

PATENT NO. : 8,844,203 B2
APPLICATION NO. : 13/662679
DATED : September 30, 2014
INVENTOR(S) : David W. Lahnala It is certified that error appears in the above-identified patent and that said Letters Patent is hereby corrected as shown below:

ON THE TITLE PAGE OF PATENT:

Item (71) Applicant, please delete "AGC Automotive Americas, Co.," and replace with -- AGC Automotive Americas Co., --

Signed and Sealed this
Tenth Day of February, 2015

Michelle K. Lee

Michelle K. Lee
*Deputy Director of the United States Patent and Trademark Office*